US005509282A

United States Patent [19]

Ferrell, Jr.

[11] Patent Number: 5,509,282

[45] Date of Patent: Apr. 23, 1996

[54] DOUBLE CUFFED HOSIERY

[76] Inventor: James M. Ferrell, Jr., 1371 Pebble Dr., Graham, N.C. 27253

[21] Appl. No.: 324,175

[22] Filed: Oct. 14, 1994

[51] Int. Cl.[6] ..... D04B 1/18; D04B 1/26; A41B 11/00

[52] U.S. Cl. ..... 66/188; 66/172 R; 66/178 R; 2/239; 2/240

[58] Field of Search ..... 66/170, 172 R, 66/172 E, 178 R, 178 E, 183, 188, 200; 2/239, 240

[56] References Cited

U.S. PATENT DOCUMENTS

| | | | |
|---|---|---|---|
| 147,810 | 2/1874 | Baron . | |
| 334,339 | 1/1886 | Branson et al. . | |
| 1,452,517 | 4/1923 | Lepow . | |
| 1,558,103 | 10/1925 | McClelland . | |
| 1,594,086 | 7/1926 | Arnold . | |
| 2,099,948 | 11/1937 | Underwood et al. | 66/178 R |
| 2,384,392 | 9/1945 | Page | 66/172 E |
| 2,494,927 | 1/1950 | Burd | 2/239 |
| 2,571,543 | 10/1951 | Connor | 2/240 |
| 2,578,895 | 12/1951 | Meengs et al. | 66/178 R |
| 2,701,458 | 2/1955 | Ducharme | 66/180 |
| 2,763,146 | 9/1956 | Minton | 66/172 R |
| 2,872,800 | 2/1959 | Davis, Jr. et al. | 66/172 R |
| 3,499,172 | 3/1970 | Milner | 2/240 |
| 3,503,077 | 3/1970 | Connelly | 2/239 |
| 3,995,322 | 12/1976 | Chesbro, Jr. | 2/239 |
| 4,253,317 | 3/1981 | Howard et al. | 66/186 |
| 4,702,091 | 10/1987 | Good et al. | 66/194 X |
| 5,035,008 | 7/1991 | Schneider | 2/239 |
| 5,067,177 | 11/1991 | Binder | 2/239 |
| 5,249,310 | 10/1993 | Forte | 2/239 |

FOREIGN PATENT DOCUMENTS

| | | | |
|---|---|---|---|
| 928991 | 6/1951 | France | 2/239 |
| 1192109 | 10/1959 | France | 66/178 R |
| 550215 | 10/1956 | Italy | 66/178 R |
| 24755 | 7/1914 | Norway | 2/239 |
| 323398 | 1/1930 | United Kingdom | 2/239 |

OTHER PUBLICATIONS

JC Penny Advertisement Aug. 20, 1994 pg. 8.

*Primary Examiner*—John J. Calvert
*Attorney, Agent, or Firm*—Rhodes, Coates & Bennett

[57] ABSTRACT

A hosiery article having a tubular upper leg portion, a lower foot portion, and a lower band interposed between the upper and lower portions. The lower band is operative to maintain the position of the upper portion relative to the mouth of a shoe. In this way, the band allows the upper portion of the hosiery article to be compressed without allowing the upper portion to enter the shoe. Preferably, the lower band protrudes outwardly. Additionally, an upper band is provided at the upper end of the upper portion to maintain the upper portion in a compressed position.

The upper leg portion is formed with a plurality of wide, crinkled ribs therein, providing a unique and desirable appearance.

15 Claims, 4 Drawing Sheets

FIG. 6
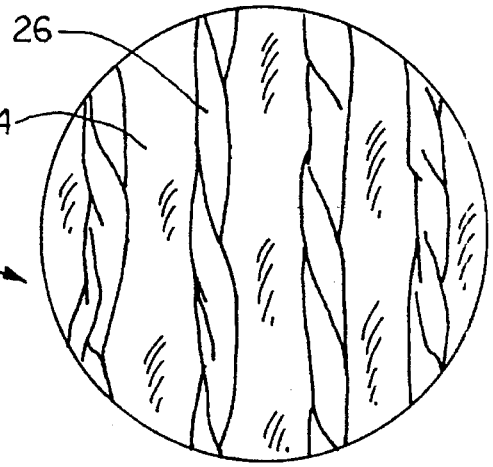
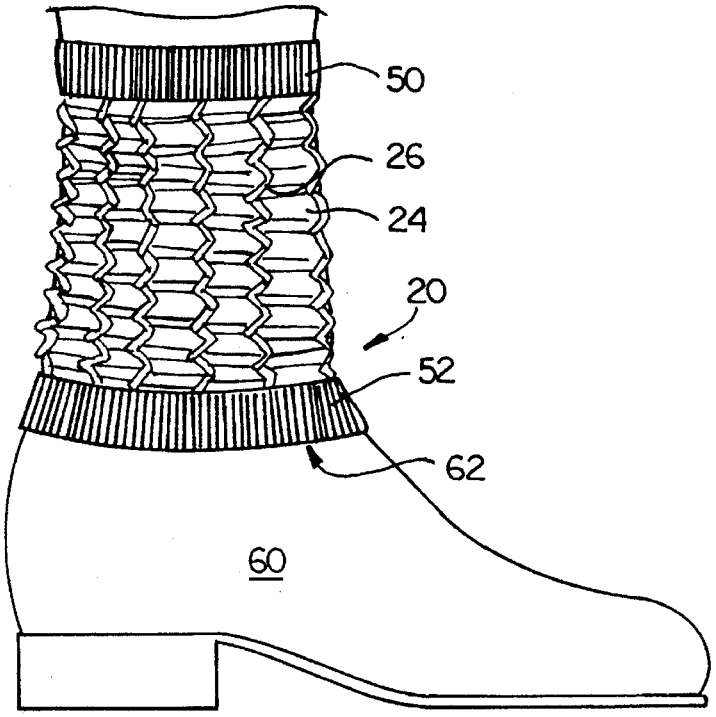
FIG. 3
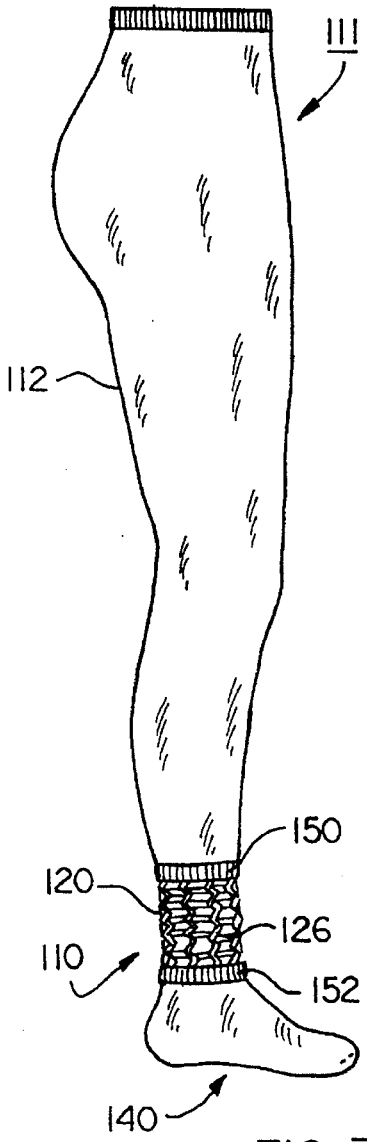
FIG. 7

DOUBLE CUFFED HOSIERY

FIELD OF THE INVENTION

The present invention is directed to hosiery, and, more particularly, to crinkle or slouch hosiery.

BACKGROUND OF THE INVENTION

Ladies and childrens socks having tops with a finished appearance to them have become increasingly popular in recent years. In particular, socks which may be pushed down about the ankles are considered fashionable. Socks of this type are generally referred to as "slouch" socks or sport socks. The top portion of the sock generally has a finished look such that it may be worn with shorts, gauchos, and the like.

Such socks are generally not available in sheerer hosiery. First, they are only constructed with heavy yarns resulting in a thick and bulky sock. Hosiery, such as pantyhose, knee-highs, thigh-highs, etc., formed of lighter or sheerer yarns have generally not been available or provided with a crinkle look. This is because of the tendency for the sheerer yarns to slide down the leg rather than hold their position. Once the upper portion of the sock has been pushed down to achieve the slouched effect, there is nothing to keep the ankle portion from working its way down into the shoe, causing discomfort and reducing the slouched appearance. This problem would even be exacerbated in sheerer or lighter weight socks.

Thus, there exists a need for an article of hosiery of the type described above which achieves a unique appearance and which does not allow the lower portion to slide down on the leg or ankle. There exists a need for a hosiery article having unique and visually appealing ribs in a portion thereof. Further, there exists a need for such an article which is cost effective to manufacture.

SUMMARY OF THE INVENTION

The present invention is directed to a decorative and functional article of hosiery, such as anklets, thigh-highs, knee-highs, or pantyhose. The hosiery includes a tubular upper portion adapted to be worn about the leg or ankle. The upper portion has an upper elastic band or web and a lower band or anchor with a relatively wide ribbed portion therebetween. The lower band is provided at the lower end of the ribbed portion and protrudes exteriorly of the lower portion. So formed, the lower band serves as an anchor to prevent the ribbed portion of the hosiery from sliding downwardly after the "slouch" appearance is achieved. The upper portion is pushed down toward the lower end of the upper portion, to form the slouch or crinkle band. The lower band anchors the crinkled portion in place and prevents sliding down the leg or into the shoe. Preferably, the lower band is ribbed and/or elasticized.

The upper band is formed at the upper end of the ribbed portion. The upper band is preferably elasticized and ribbed, and serves to frictionally engage the leg, and thereby hold the upper end of the upper portion in a selected position on the leg spaced from the lower band to form the crinkle section.

The ribbed portion includes a plurality of spaced-apart, relatively wide ribs formed along its length to provide a desirable visual effect. The wide ribs provide an attractive crinkled or twisted appearance when the upper band is slid down closer to the lower band.

An object of the present invention is to provide a decorative and functional article of hosiery.

An object of the present invention is to provide a hosiery article, as described above, which may be worn in a slouch or crinkled position and which will maintain the selected position on the leg or ankle.

Yet another object of the present invention is to provide a hosiery article, as mentioned above, having crinkled ribs along a selected portion, providing a unique and desirable visual effect.

BRIEF DESCRIPTION OF THE DRAWINGS

FIG. 3 is a side elevational view of the sock of the present invention shown in a crinkled position and in conjunction with a shoe.

FIG. 6 is a fragmentary view of the upper portion of the sock showing a rib formed thereon.

FIG. 7 is a side elevational view of a pantyhose including a sock according to the present invention.

DETAILED DESCRIPTION OF THE INVENTION

Figure 1:
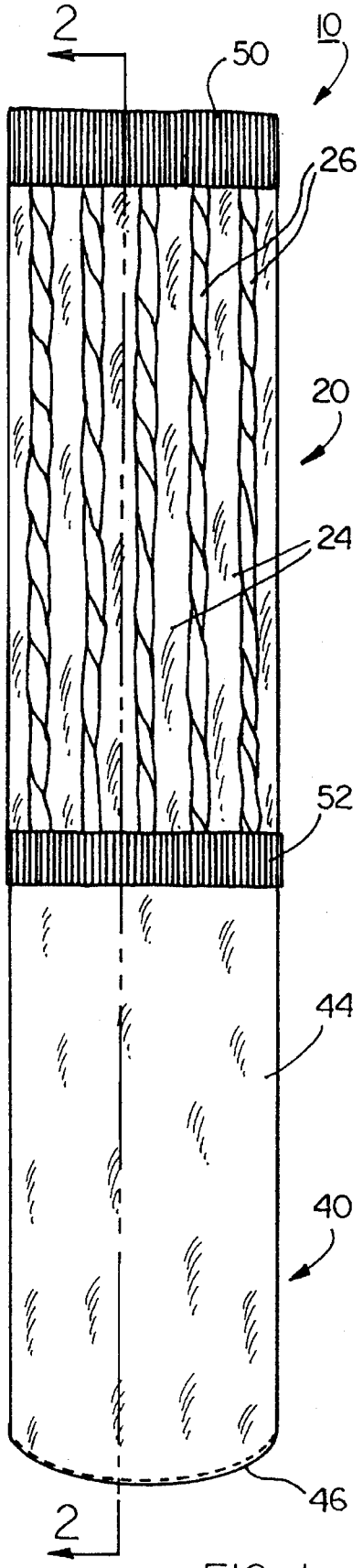
FIG. 1 is a front elevational view of a substantially flattened sock according to the present invention.
Figure 2:
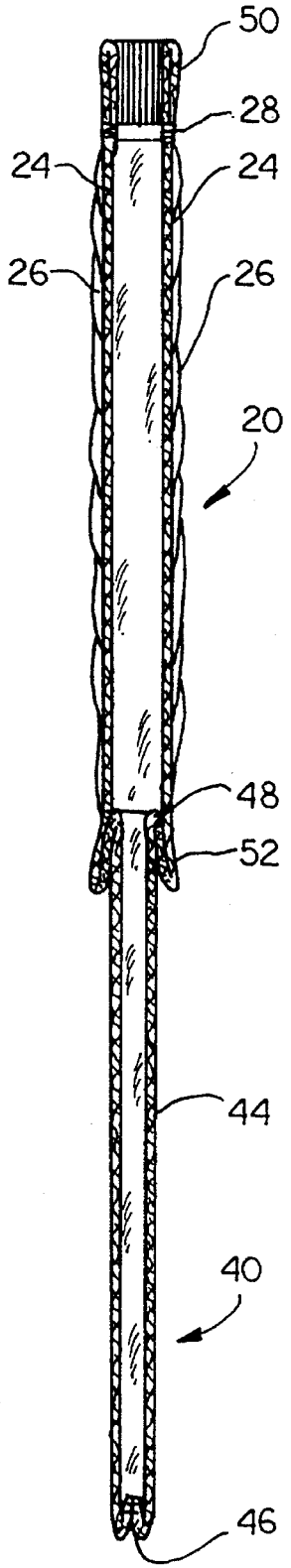
FIG. 2 is a side cross-sectional elevational view of the sock of the present invention taken along the line 2—2 of FIG. 1.

With reference to FIGS. 1–3, a crinkled hosiery article according to the present invention is shown therein and generally denoted by the numeral 10. Hosiery article 10 includes upper leg portion 20 and lower foot portion 40. Upper band 50 is integrally formed with the upper end of upper portion 20. Lower band 52 is integrally formed between upper portion 20 and lower portion 40.

Lower portion 44 is formed from tubular body portion 44 which is closed at its lower end by stitching 46. In the design of FIGS. 1–3, lower portion 40 is preferably sized and shaped to receive the portion of a foot extending from the mouth 62 of a shoe 60 to the end of the wearer's toes. Lower portion 40 may be formed longer than shown in the figures in order to accommodate a shoe having a higher mouth, such as a boot, or to form other types of hosiery as discussed below.

Upper portion 20 includes tubular body 24 having outwardly projecting, twisted, decorative ribs 26 formed thereon (as best seen in FIG. 6). Upper portion 20 has a length of at least about 6 inches long stretched or about 4 inches long relaxed, in order to achieve the desired crinkle effect. Preferably, the upper portion is between 6 inches and 18 inches in length stretched or between 4 inches and 10 inches long relaxed and not finished, depending on the application.

Upper band 50 is preferably double-ply, ribbed, and elasticized so as to provide sufficient frictional engagement with the wearer's leg to hold the upper end of the upper portion in place while remaining comfortable to the wearer.

Lower band 52 is preferably double-ply, ribbed, and elasticized. Lower band 52 surrounds the upper end of lower portion 40. Preferably, lower band 52 extends downwardly from stitching 48, thereby forming a protruding, downwardly extending cuff. Lower band 52 is preferably elasticized so as to provide a sufficient frictional engagement with the wearer's leg to hold the upper end of the lower portion in place while remaining comfortable to the wearer.

With particular reference to FIG. 3, hosiery article 10 may be used as follows. In typical fashion, the hosiery article is placed on the wearer's foot and a shoe is placed over the hosiery article. The lower portion is preferably sized such that the upper end thereof extends just to or above the mouth 62 of shoe 60 when the shoe is placed on the foot. Lower band 52 remains outside of the shoe. Lower band 52 flares or protrudes outwardly and surrounds mouth 62. Upper band 50 may be pushed down the wearer's leg, causing upper portion 20 to crinkle as shown in FIG. 3. It will be appreciated that, because lower band 52 is braced against the mouth of the shoe, the lower end of upper portion 20 is anchored and will not be displaced downwardly by the aforementioned crinkling step. Furthermore, because of this bracing, upper portion 20 will resist the common tendency to migrate down into the shoe due to the mechanics of walking. Because lower band 52 is elasticized, it will generally be unnecessary to put on the shoe prior to crinkling upper portion 20, as the elasticity will serve to at least temporarily anchor the lower end thereof. However, it should be noted that because lower band 52 flares outwardly, in the design shown in FIGS. 1–3 the elasticity therein may be reduced or eliminated as desired and the lower band will still serve to anchor the hosiery article while the shoe is on.

While the hosiery article of the present invention has been shown for use with a shoe having a mouth proximate the wearer's ankle, the hosiery article may be adapted for use in other applications. For example, lower portion 44 may be extended to accommodate a shoe having a higher mouth, such as a boot, in which case lower band 52 will anchor the hosiery article against the mouth of the boot. Lower portion 44 may be further extended so that lower band 52 and upper portion 20 may be pulled over the wearer's knee and even as high as the wearer's thigh, forming a decorative thigh-high. The elasticity of the lower band in these applications serves to hold the lower end of the upper leg portion in place.

In a further embodiment, shown in FIG. 7, a hosiery article 110 according to the present invention is integrally formed with leggings 112, thereby forming tights or pantyhose 111. Hosiery article 110 includes upper band 150, lower band 152, upper portion 120, lower portion 140, and ribs 126, corresponding to elements 50, 52, 20, 40 and 26 of the first embodiment.

With the aforementioned overall construction and purposes in mind, the following knitting procedures and yarn construction are preferred for forming hosiery article 10 according to the present invention. Preferably, the upper and lower ribbed bands are formed using a 2×3 (i.e., the first two needles up or engaging the yarn and the next three needles down, and so forth) double ply. Upper portion 20 is formed using a 20×20 positive float (i.e., the first 20 needles up or active and the next 20 needles down, and so forth) which provides a wide, crinkled, rib pattern. The lower portion is formed using all needles up, except on a textured or patterned fabric as discussed below.

Preferably, a cylinder and dial machine is used, with four feeds being used. An example of a suitable machine is the Lonati L404 with four feeds electronic selection. This machine is a 400-needle, 75-gauge machine (75 gauge meaning the thickness of all flat parts, including needles, sinkers, cylinder jacks and dial jacks), often referred to as a fine gauge knitting machine.

The knitting procedure begins with a standard make-up procedure using dial jacks and a 1×3 needle selection (one needle up and three needles down) to form the loops on the dial. By using a 1×3 needle selection in conjunction with the dial jack, a loop is formed over every two dial jacks. This procedure serves to hold the fabric for the plying or doubling of the upper band. The needles of the 1×3 selection go up between every two jacks. The yarn is laid over the dial jacks and the needles pull the yarn down. As the needles go below the dial jacks, the needles hold the yarn to form a loop around the two dial jacks.

Figure 5:
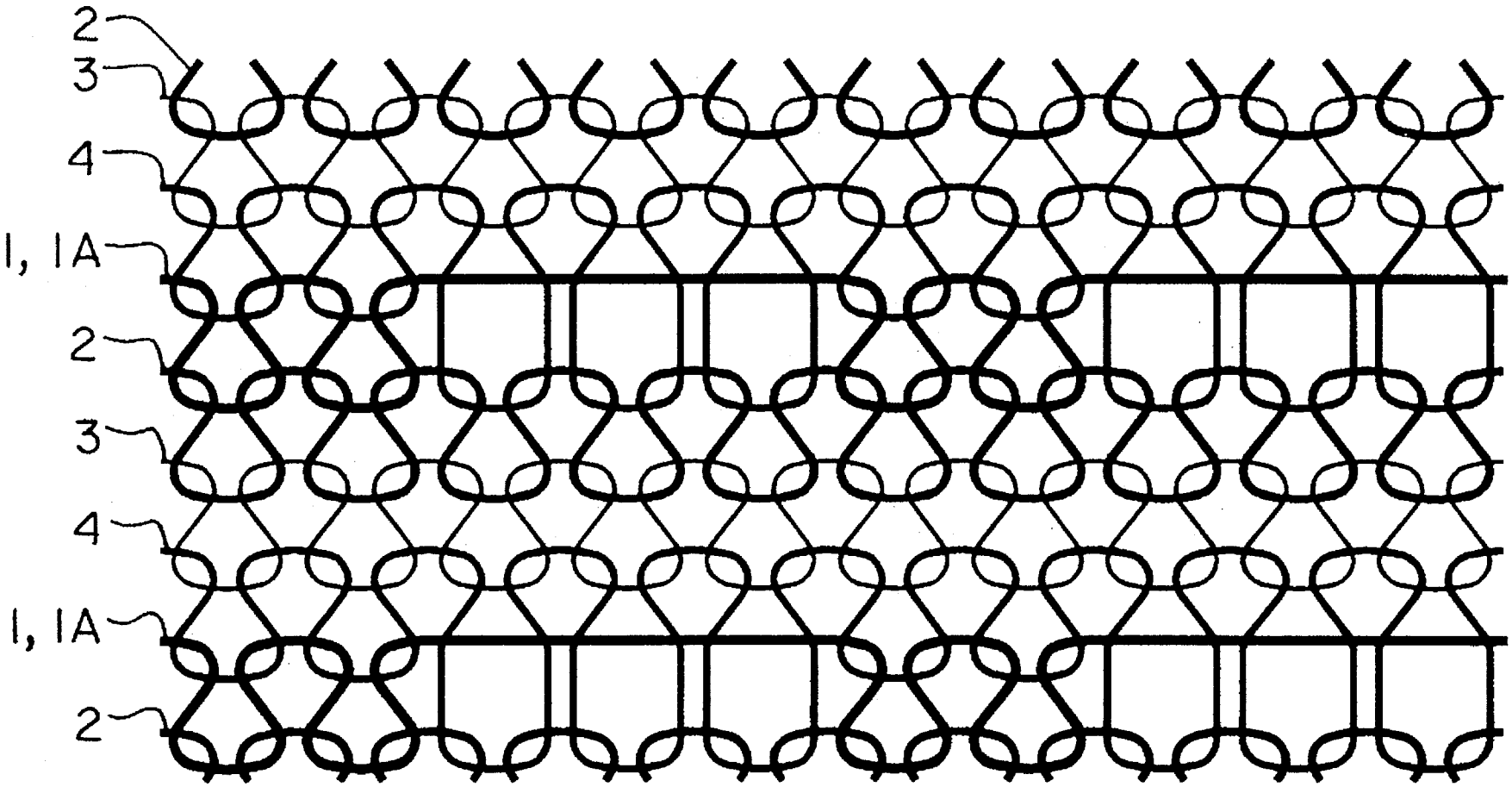
FIG. 5 is a diagram of the stitch construction of the upper and lower bands.

Next, a 2×3 needle selection is chosen. With reference to FIG. 5, for the 2×3 needle selections of the upper and lower bands, one end of about 70 to 100 denier textured nylon, preferably 100 denier, is provided at each feed, elements 1, 2, 3, and 4 being provided at feeds #1, #2, #3, and #4, respectively. One end of double covered lycra 1A is additionally provided at feed #1 so that the courses formed at feed #1 are plated. The lycra yarn 1A floats behind the three needles that are down and forms float loops at those needles rather than knitted loops. The two needles that are up form knitted loops, thereby knitting the lycra yarn 1A into the loops. By using this selection, the lycra yarn that is not knitted into loops tends to draw together because less yarn is required to pass behind the needles than to form a knitted loop. In this way, a ribbed effect is achieved, the two needles that are up forming the actual rib. The foregoing procedure is executed on feed #1 only, as a clear float selection. The clear float selection may be achieved by leaving the tuck cam and the clear cam in the "in" position. All of the needles in the remaining feeds are up.

Next, the dial bits and needles are used to form the second ply of the double-ply 2×3 upper band. Using a 1×1 positive float needle selection (i.e, one needle up and one needle down at sinker level) in conjunction with the dial jacks, the loops are shed from the dial. A needle is brought up between each dial jack. As the needles go back down and the dial jacks go back inside the dial, a loop is formed. The needles tie the fabric together (stitching 28), thereby forming a double or plied upper band.

For the 20×20 positive float selection of the upper portion, one end of double covered lycra 1B is provided at feed #1, one end of single covered lycra 3B is provided at feed #3, and one end of about 70 to 100 denier textured nylon, preferably 100 denier, is provided at each of feeds #2 and #4 (denoted as elements 2B and 4B, respectively). The two ends of nylon 2B, 4B are preferably textured yarns of the same twist direction, causing the ribs of the upper portion to have a torque effect resulting in a desirable crinkled or twisted appearance.

Figure 4:
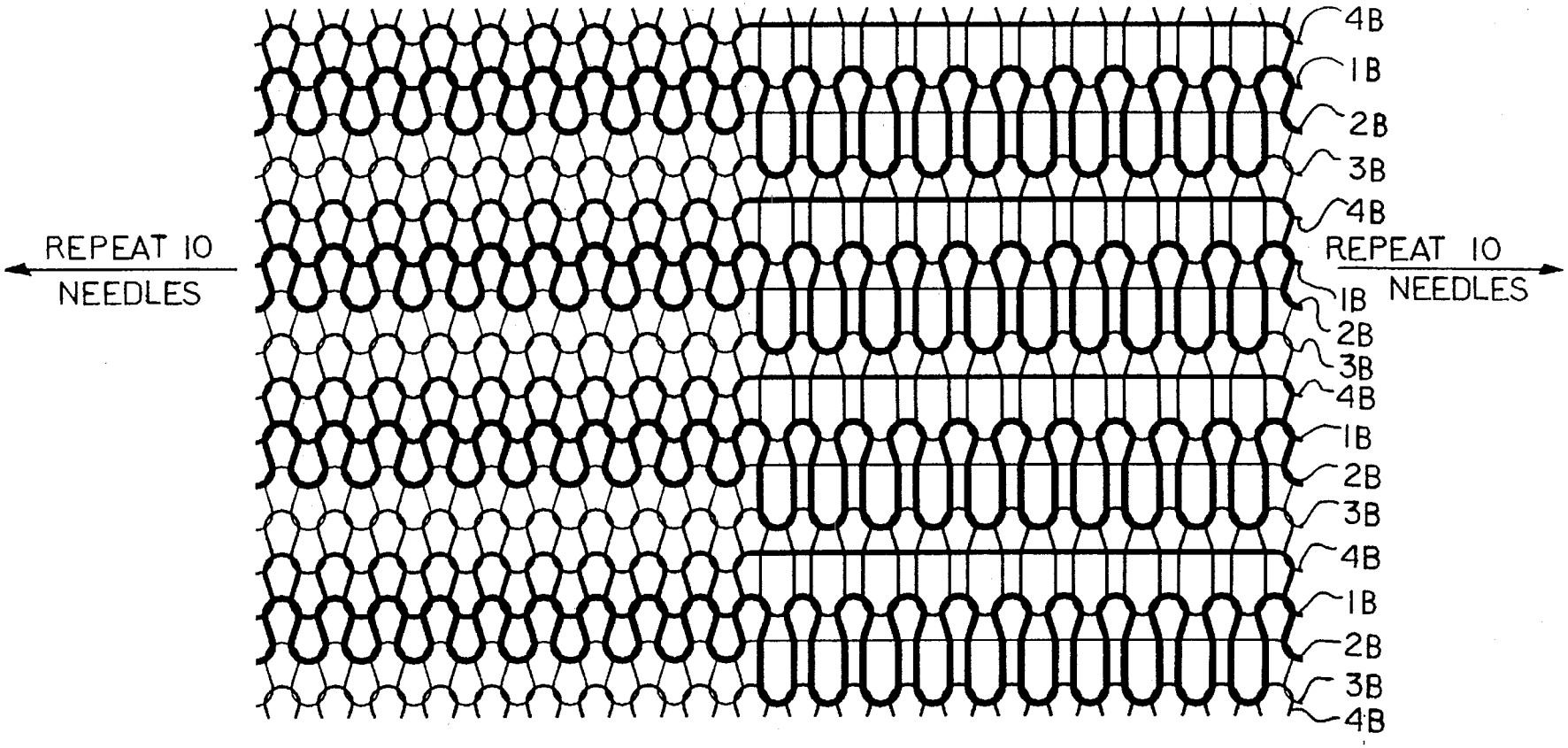
FIG. 4 is a diagram of the stitch construction of the upper leg portion of the sock showing a portion of the construction of the ribs.

With reference to FIG. 4, following the formation of the upper band, a 20×20 positive float selection is selected on feeds #1 and #3 only. That is, twenty consecutive needles are up, followed by 20 consecutive needles down and so forth at feeds #1 and #3, while all of the needles at feeds #2 and #4 are up. This selection is achieved at feeds #1 and #3 by leaving the tuck cams in and bringing the clear cams out. By doing this, the needles that are down are taken out of action (i.e., there is no fabric on these needles at all). The lycra yarns 1B, 3B that are floated in on this selection are not knitted into a loop because the needles are out of action. The lycra yarns lay unknitted or behind the needles and tend to draw together.

The foregoing selection produces a wide ribbed effect. Moreover, the ribs thus formed are crinkled or twisted. It has been found that the desired effect may be achieved using as many as 20 successive float loops or as few as 10 successive float loops. The resulting stitch construction is shown in FIG. 4. Note that, for clarity, FIG. 4 only shows the middle twenty stitches, there being ten float loops to the right of the construction shown and ten knit loops to the left of the construction shown. Every other course consists of twenty knit loops, followed by twenty float loops, followed by twenty knit loops, and so forth. The remaining courses consist of continuous knit loops with no float loops. It is not necessary that there be an equal number of knit loops and float loops. For example, a 15×15 needle selection could be used.

After the 20×20 positive float upper portion has been knitted, the dial jacks are brought back out to form the loops for the lower 2×3 band. By using the dial again as discussed in the formation of the upper band, the second 2×3 band is flared outward and formed in a double ply, the ends of the ribbed fabric joined by stitching 48. The lower band is formed using the procedure described above for forming the upper band, the stitch construction being as shown in FIG. 5.

Suitable nylon yarns include 70/34 textured nylon. Suitable lycra yarns include 3650 double covered lycra and 4034 single covered lycra.

Lower portion 44 is formed using all needles in the machine in conjunction with yarns from all feeds knitted on every loop, except on a textured or patterned lower portion. On a textured or patterned fabric, selective knitted loops are used to form the pattern.

The present invention may, of course, be carried out in other specific ways than those herein set forth without departing from the spirit and the essential characteristics of the invention. The present embodiments are, therefore, to be considered in all respects as illustrative and not restrictive and all changes coming within the meaning and equivalency range of the appended claims are intended to be embraced therein.

What is claimed is:

1. A decorative and functional article of hosiery comprising:

a) an upper leg portion arranged and configured to fit about the leg and ankle and being open at the uppermost end thereof, said leg portion having a crinkle section, said crinkle section comprising:

i) a plurality of wide ribs separated by a wide section of plain knit;

ii) said wide ribs including alternating courses of textured synthetic yarns and elastic yarns, said textured yarns including knit stitches in substantially all wales, said elastic yarns having alternating wale sections of knit stitches and floated stitches, said knit and floated stitches extending at least 10 wales;

b) a lower foot portion arranged and configured to fit snugly about the foot;

c) a lower band provided at a selected point along said leg portion below the uppermost end of said leg portion; and d) whereby said leg portion may be compressed by pushing a section of said upper leg portion above said lower band down towards said lower band.

2. The hosiery article of claim 1 further including an upper band secured to said leg portion above said lower band, said upper and lower bands operative to frictionally engage the leg and thereby hold said upper and lower bands of said leg portion in a selected position.

3. The hosiery article of claim 1 wherein said lower band extends outwardly with respect to said lower portion.

4. The hosiery article of claim 1 wherein said lower band is elasticized.

5. The hosiery article of claim 1 wherein said lower band is ribbed.

6. The hosiery article of claim 2 wherein said upper band is elasticized.

7. The hosiery article of claim 2 wherein said upper band is ribbed.

8. A method for forming a hosiery article, comprising the steps of:

a) knitting an upper band;

b) knitting a tubular upper leg portion including forming a plurality of longitudinal ribs in said tubular upper leg portion by knitting a float stitch having from about 10 to about 20 substantially consecutive float loops in a plurality of courses, followed by from about 10 to about 20 knit loops in the same courses;

c) knitting a lower outwardly flared band;

d) knitting a tubular lower foot portion; and e) stitching one end of the lower portion.

9. The method of claim 8 wherein the yarn knitted into the float stitch is elastic.

10. The method of claim 8 wherein the yarn in another of the plurality of courses is knit without a float stitch.

11. An article of hosiery formed of relatively light yarns of less than 150 denier and having a crinkle section, wherein said crinkle section comprises:

(a) a plurality of wide ribs separated by a wide section of plain knit;

(b) said wide ribs including alternating courses of textured synthetic yarns and elastic yarns, said textured yarns including knit stitches in substantially all wales, said elastic yarns having alternating wale sections of knit stitches and floated stitches, said knit and floated stitches extending at least 10 wales.

12. An article of hosiery formed of relatively light yarns of less than 150 denier and for wearing with a shoe, the shoe having a mouth, comprising:

a) a tubular upper portion having an upper end and a lower end;

b) a lower portion having an open end and a closed end;

c) a lower band interposed between said upper and lower portions, said lower band operative to maintain said open end in a position relative to the mouth of the shoe; and d) wherein said tubular upper portion includes a crinkle section, said crinkle section comprising:

i) a plurality of wide ribs separated by a wide section of plain knit;

ii) said wide ribs including alternating courses of textured synthetic yarns and elastic yarns, said textured synthetic yarns including knit stitches in substantially all wales, said elastic yarns having alternating wale sections of knit stitches and floated stitches, said knit and floated stitches extending at least ten wales.

13. The hosiery article of claim 12 wherein said lower band flares outwardly with respect to the lower portion.

14. The hosiery article of claim 12 wherein said lower band is elasticized.

15. The hosiery article of claim 12 further including an elasticized upper band.

* * * * *